United States Patent [19]

Swan

[11] Patent Number: 4,953,523

[45] Date of Patent: Sep. 4, 1990

[54] QUICK RELEASE MECHANISM FOR THE TOOL OF A CONCRETE/ASPHALT ABRADER

[75] Inventor: Leo Swan, Jefferson, Md.

[73] Assignee: Equipment Development Company, Inc., Frederick, Md.

[21] Appl. No.: 421,941

[22] Filed: Oct. 16, 1989

[51] Int. Cl.[5] ..... B28D 1/00; B24B 23/02

[52] U.S. Cl. ..... 125/14; 51/176; 51/177; 299/39

[58] Field of Search ..... 51/176, 177, 178, 241 G; 125/14; 299/13 SS, 39

[56] References Cited

U.S. PATENT DOCUMENTS

| | | | |
|---|---|---|---|
| 2,031,665 | 2/1936 | Myers | 51/176 |
| 2,277,236 | 3/1942 | Kneisley et al. | 51/176 |
| 2,673,725 | 3/1954 | Coates | 51/176 |
| 3,156,231 | 11/1964 | Harding, Jr. | 51/176 |
| 3,301,601 | 1/1967 | Zuzelo | 51/176 |
| 3,357,745 | 12/1967 | Cooper | 51/176 |
| 3,387,891 | 6/1968 | Simms et al. | 51/176 |

FOREIGN PATENT DOCUMENTS 0005240 of 1910 United Kingdom ..... 51/174

*Primary Examiner*—Robert A. Rose

*Attorney, Agent, or Firm*—Birch, Stewart, Kolasch & Birch

[57] ABSTRACT

A quick release mechanism for disengaging the cutting blade of a masonry saw is disclosed. Rotation of a threaded shaft to achieve axial movement through a closed partially threaded split collar lowers the cutting tool onto the work surface via a counterpivot mechanism which simultaneously compresses a gas spring. Only one half of the collar has threads complementary to those of the threaded shaft and pivots away from an opposing fixed unthreaded collar portion. Upon actuation of a release device, the threaded portion of the split collar pivots to an open position to disengage the threaded shaft whereby reverse axial movement of the threaded shaft and resultant upward disengagement of the cutting tool occur as the gas spring decompresses.

11 Claims, 2 Drawing Sheets

QUICK RELEASE MECHANISM FOR THE TOOL OF A CONCRETE/ASPHALT ABRADER

BACKGROUND OF THE INVENTION

1. Field of the Invention

Generally this invention relates to cutting tools and more particularly to a quick release mechanism for disengaging the cutting tool of a concrete/asphalt abrader used in construction and maintenance of road surfaces, parking lots, industrial plant floors and like surfaces made from stone aggregate.

2. Description of the Prior Art

The prior art for disengaging a cutting tool of a concrete/asphalt abrader from the workpiece has consisted simply of reverse operation of the engagement means. The prior art has not provided a quick release tool disengagement assembly, which is simple, safe and easy-to-use.

Furthermore, the prior art for abraders useable for the above purposes and readily moveable from one location to another has relied on the mass of the abrader assembly to hold the tool on or in the workpiece. It has not provided means to otherwise maintain the tool under tension during operation and prevent workpiece irregularities from causing the cutting tool to unintentionally disengage from the workpiece.

SUMMARY OF THE INVENTION

The main object of the present invention is the provision of a relatively easy to operate release mechanism for quickly disengaging the cutting tool of a concrete/asphalt abrader, such as a cutter, grinder or planer.

Another object is to provide a quick release mechanism which decreases the time and physical effort required for disengaging a tool from a workpiece such that the abrader operator can more efficiently accomplish the complete work task to be performed.

Another object is to provide a quick release mechanism for disengaging the tool from a workpiece when emergency, safety or quality control circumstances so dictate.

Yet another object is to provide a quick release mechanism for disengaging and retracting a tool from a workpiece upon operator actuation but which exerts, during engagement of the tool, a tension force to retain the tool in engagement upon the workpiece.

Briefly, the invention is directed to a quick release mechanism for a cutting tool including gas spring means which is compressed upon the engagement of the tool by the manual rotation of a threaded shaft, the resilient means being permitted to decompress and disengage the cutting tool upon operation of a lever to disengage a screw threaded holding surface from the threaded shaft.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will be better understood from the detailed description given hereinbelow and the accompanying drawings with which are given by way of illustration only, and thus, are not limitative of the present invention and wherein.

DETAILED DESCRIPTION OF THE INVENTION

Generally, in a conventional concrete/asphalt abrader, the cutting tool is supported by wheels affixed to the rearward end of the main frame and by wheels affixed to the forward end of a fork assembly, with the main frame and the fork assembly being pivotally connected at a mid region between the supporting wheels. In the case of a concrete masonry saw, a circular cutting blade or disk is attached to the forward end of the main frame. To use the cutting blade, the main frame and the fork assembly are pivoted relative to each other until the blade lowers and engages the workpiece such as a road surface or a floor of a building to the depth of cut desired.

To pivot the main frame and the fork assembly and thereby engage the cutting blade, the saw operator moves the cut control linkage downward which in turn relatively pivots the wheeled end of the fork assembly upward and the cutting blade end of the main frame downward. The downward movement of the cutting blade can thus be continued until the desired depth of blade cut is attained whereupon the downward movement of the cut control linkage is terminated. Disengagement of the blade occurs by moving the cut control linkage upward.

Figure 1:
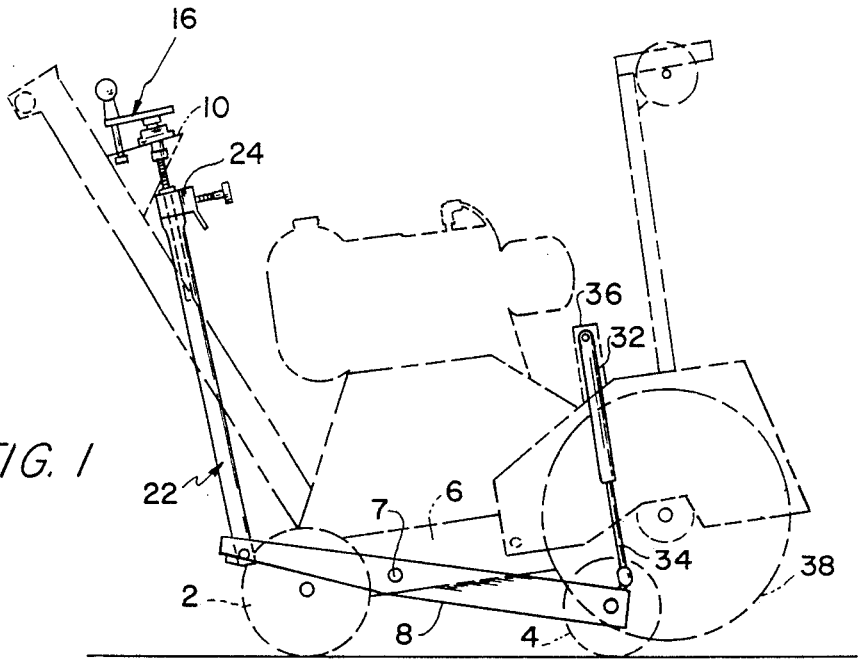
FIG. 1 illustrates a side elevational view of the quick mechanism assembly of a tool engagement/disengagement linkage of a masonry saw in accordance with the subject invention.

FIG. 1 shows a concrete/asphalt abrader, specifically a rotary circular saw assembly, supported for use by wheels 2 and 4 which are mounted on the rear portion of a main frame 6 and the front portion of a fork assembly 8, respectively. The main frame 6 and fork assembly 8 are pivotally connected at pivot 7 between wheels 2 and 4. Mounted on the control platform 10 affixed to the handle bar assembly 12 is a bushing 14. A crank assembly 16 is mounted on the bushing 14. The assembly 16 consists of a manually rotable handwheel 18 from which a shaft 20 is supported for rotation within bushing 14, shaft 20 extending through bushing 14 to engage the cut control linkage 22 at the collar assembly 24. The handwheel 18 is rotated by lifting ball knob handle 26 to extract it from a safety hole 28 in platform 10 and rotating it about the longitudinal axis of shaft 20.

Figure 4:
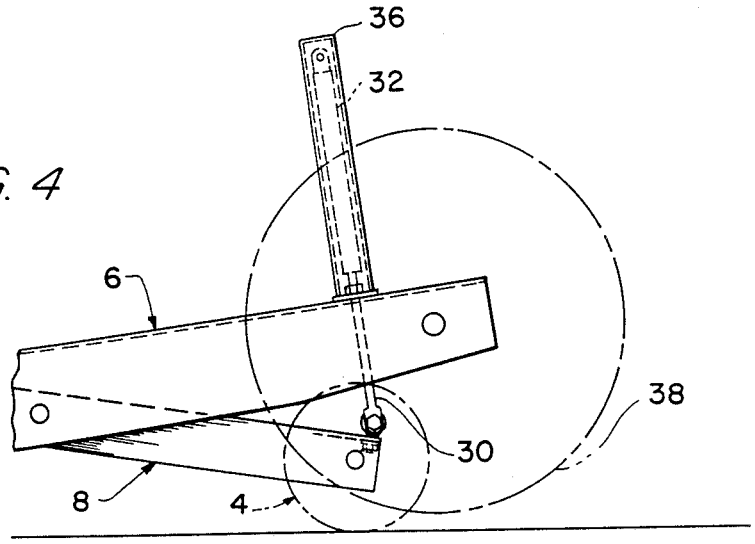
FIG. 4 is a partial side elevational view of the gas spring shown in FIG. 1 in a decompressed state with the cutting tool disengaged.

The upper portion of the shaft 20 has a threaded portion 30, the threads of which engage complementary threads in the collar assembly 24, which is described in greater detail hereinbelow. The cut control linkage 22 upon which the collar assembly 24 is mounted, extends downward to be pivotally attached at its lower end to the rear portion of the fork assembly 8. At the front end of the fork assembly 8, a cylindrical gas spring 32 is pivotally attached via the lower end of the cylinder piston rod 34. The gas spring 32 extends upward from the front end of the fork assembly 8 and is connected via its outer cylinder wall to a support structure 36 mounted on the front portion of the main frame 6, as shown in greater detail in FIG. 4. Additionally, mounted on the front portion of the main frame 6 is a cutting tool comprising a circular cutting blade 38.

Figure 2:
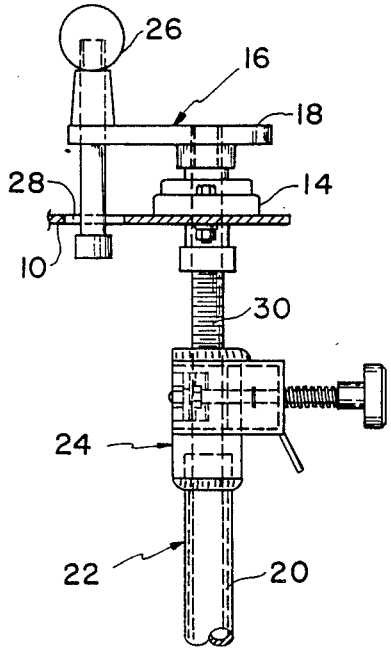
FIG. 2 is a partial side elevational view illustrative of the collar assembly of the quick release assembly shown in FIG. 1.

FIG. 2 shows in greater detail the interrelationship of the collar assembly 24 with the threaded portion 30 of the shaft 20. To axially move the shaft 20, the ball knob 18 is lifted upward to remove the ball knob handle 26 from a safety hole 28 in the platform 10 and the handwheel 18 is then rotated. As the shaft 20 rotates, the threaded portion 30 engages the complementary threads on one half of the collar assembly 24 to axially move the cut control linkage 22 as shown in FIGS. 3A and 3B.

Figure 3A:
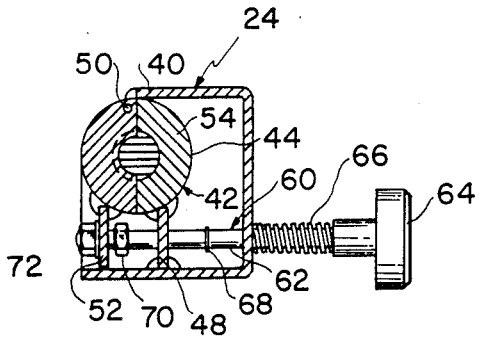
FIG. 3A illustrates a transverse cross-sectional view of the collar assembly of FIG. 2 with the multi-jawed collar in the closed position.
Figure 3B:
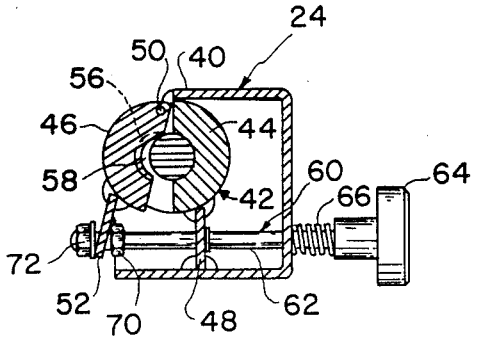
FIG. 3B illustrates a transverse cross-sectional view of the collar assembly of FIG. 2 with the multi-jawed collar in the open position.

Respectively, FIGS. 3A and 3B show the collar assembly 24 in a closed position wherein the threaded portion 30 of the shaft 20 are engaged with the complementary threads of the collar assembly24 and in an open position wherein the threaded portion 30 of the shaft 20 are disengaged from the complementary threads of the collar assembly 24.

The collar assembly 24 has a perimeter support wall 40. Within the support wall 40 is a multi-jawed collar 42 consisting of a fixed jaw 44 and a pivotable jaw 46, the fixed jaw 44 being secured to the support wall 40 by fixed tab 48 which is rigidly affixed at opposite ends to the fixed jaw 44 and the support wall 40, respectively. The pivotable jaw 46 is attached by a pivot pin 50 to an extension of the support wall 40. Generally, on the opposite side of the pivotable jaw 46 from the pivot pin 50, a pivot tab 52 is rigidly affixed thereto. The fixed jaw 44 has a smooth inner arcuate surface 54 which communicates with the threaded portion 30 of the shaft 20, while the pivotable jaw 46 has a threaded inner arcuate surface 56 which has threads 58 complementary to those of the threaded portion 30 of the shaft 20. In addition to the multi-jawed collar 42, the collar assembly 24 has a release plunger 60, consisting of a plunger shaft 62, a knob 64, a spring 66, a fixed collar bushing 68, a nut bushing 70 rigidly affixed to the plunger shaft 62, and an end cap 72. The plunger shaft 62 extends from the knob 64 through the support wall 40 and through the fixed tab 48 and the pivot tab 52, with the spring 66 being biased in an uncompressed state between the support wall 40 and the knob 64 to push the knob 64 away from the support wall 40 thereby maintaining the multi-jawed collar 42 in a closed position.

To open the jaws of the multi-jawed collar 42, the knob 64 is depressed as shown in FIG. 3B causing the plunger shaft 62 to move through the fixed tab 48 until the nut bushing 70 engages and moves the pivot tab 52 and pivots the pivotable jaw 46 about the pivot pin 50 to disengage the threads 58 of the threaded inner arcuate surface 56 from the threaded portion 30 of the shaft 20. When the complementary threads 58 are disengaged from the threaded portion 30, the cut control linkage 22 is free to move upward and will do so under influence of the compressed gas spring 32.

In operation, the operator of the saw shown in FIG. 1 rotates the handwheel 18 which rotates the shaft 20, the threaded portion 30 of which, in engaging the complementary threads of the pivotable jaw 46 of the multi-jawed collar 42 moves the cut control linkage 22 axially downward. The downward movement moves the rear portion of the fork assembly 8 downward, such movement being transmitted via the pivot connection 7 with the main frame 6 to move the front portion thereof downward. Consonant with this movement the cutting blade 38 is lowered onto and into the workpiece e.g. the surface of a concrete slab on roadway and the piston rod 34 moves upward to compress the gas spring 32, the cutting blade 38 being held in engagement with the work surface by the tension force arising from the compression of the gas spring 32. To quickly disengage the cutting blade 38 from the workpiece, the release plunger 60 is actuated to pivot the pivotable jaw 46 of the multi-jawed collar 42 until threads 58 and threaded portion 30 are disengaged thereby permitting the cut control linkage 22 to move upward as the decompressive force of the gas cylinder spring 32 is transmitted through the linkage.

The invention being thus described, it will be obvious that the same may be varied in many ways. Such variations are not to be regarded as a departure from the spirit and scope of the invention, and all such modifications are intended to be included within the scope of the following claims. For instance, it is to be appreciated that the quick release assembly, while illustrated with respect to a masonry saw, is adaptable to any concrete/asphalt surfaces, planer, scarifier, or similar apparatus.

I claim:

1. A quick release mechanism for retracting a cutting or abrading tool of masonry cutting apparatus from a work surface, comprising:

tool positioning means, including a cut control linkage and a screw threaded rod moveable axially to actuate the cut control linkage to engage the tool upon the work surface;

compression spring means connected to the cut control linkage, said spring means being compressed when said tool positioning means is operated to engage a tool upon the work surface;.and quick release means mounted on said cut control linkage, said quick release means including a support structure, a separable split collar housing a first and a second collar portion, each of said collar portions having an inner surface engageable with said threaded rod, said first collar portion further being pivotally affixed to said support structure and moveable between a closed position and an open position, said inner surface of said first collar portion also being threaded and engaging threads on said threaded rod when in said closed position, said second collar portion being rigidly fixed to said support structure, said inner surface of said second collar portion being unthreaded and frictionally engaging said threaded rod, and manually operable release means attached to said first collar portion and biased to maintain said first collar portion in said closed position, said release means being operable when actuated to pivot said first collar portion away from said second collar portion to said open portion whereby said compressing spring expands to drive said cut control linkage axially upward and to disengage the tool from the work surface.

2. A quick release assembly according to claim 1 wherein said compression spring means comprises a gas spring.

3. A quick release assembly according to claim 1 wherein said tool comprises a rotary saw blade.

4. A quick release assembly according to claim 3 wherein said cutting apparatus includes a frame and wherein said cut control linkage includes an elongated member pivotally attached to said frame and having one end connected to said threaded rod and the other end to said compression spring means.

5. A quick release assembly according to claim 4 wherein said frame includes a front end and a rear end, said saw blade being mounted on said front end and additionally including a first set of wheels mounted on said rear end of said frame and a second set of wheels mounted on said elongated member at said front end of said frame adjacent said compression spring means.

6. A quick release assembly according to claim 4 wherein said release means comprises a spring loaded linear actuator assembly located on said support structure.

7. A quick release assembly according to claim 4 wherein said tool positioning means includes means for rotating said screw threaded rod to lower and position said saw blade on the work surface.

8. A quick release assembly according to claim 7 wherein said means for rotating comprises a crank assembly attached to the upper end of said threaded rod.

9. A quick release assembly according to claim 8 wherein said crank assembly includes a manually rotable handwheel.

10. A quick release assembly according to claim 9 wherein said first and second collar portions comprise elongated generally semi-cylindrical members having arcuate inner surfaces.

11. A quick release assembly according to claim 5 wherein said compression spring means comprises a gas spring including a piston member and a piston rod member and wherein one of said members is attached to said elongated member and the other of said members is attached to said frame.

* * * * *